United States Patent [19]

Yoshiyuki et al.

[11] Patent Number: 4,556,773

[45] Date of Patent: Dec. 3, 1985

[54] HIGH FREQUENCY HEATING APPLIANCE HAVING PROTECTION AGAINST RUSH CURRENTS

[75] Inventors: Takada Yoshiyuki, Sakurai; Tamura Haruhisa, Nara, both of Japan

[73] Assignee: Matsushita Electric Industrial Co., Ltd., Kadoma, Japan

[21] Appl. No.: 642,720

[22] PCT Filed: Mar. 12, 1982

[86] PCT No.: PCT/JP82/00067

§ 371 Date: Nov. 18, 1982

§ 102(e) Date: Nov. 18, 1982

[87] PCT Pub. No.: WO82/03306

PCT Pub. Date: Sep. 30, 1982

Related U.S. Application Data

[63] Continuation of Ser. No. 444,394, Nov. 18, 1982, abandoned.

[30] Foreign Application Priority Data

Mar. 20, 1981 [JP] Japan ..... 56-40927

[51] Int. Cl.[4] ..... H05B 6/64

[52] U.S. Cl. ..... 219/10.55 C; 219/10.55 B

[58] Field of Search ..... 219/10.55 C, 10.55 D, 219/10.55 B

[56] References Cited

U.S. PATENT DOCUMENTS

| | | | |
|---|---|---|---|
| 3,699,300 | 10/1972 | Buerki | 219/10.55 C |
| 3,816,688 | 6/1974 | Fritts | 219/10.55 C |
| 4,054,769 | 10/1977 | Anderson et al. | 219/10.55 C |
| 4,321,447 | 3/1982 | Lamb | 219/10.55 B |
| 4,345,135 | 8/1982 | Harmon | 219/10.55 B |

FOREIGN PATENT DOCUMENTS

| | | |
|---|---|---|
| 51-41696 | 11/1976 | Japan . |
| 52-132343 | 10/1977 | Japan . |
| 55-80898 | 6/1980 | Japan . |
| 2039175 | 7/1980 | United Kingdom . |

*Primary Examiner*—C. L. Albritton
*Assistant Examiner*—M. M. Lateef
*Attorney, Agent, or Firm*—Wenderoth, Lind & Ponack

[57] ABSTRACT

A high frequency heating appliance has a monitor circuit for a door switch, wherein a current-limiting resistor and a fuse are provided in the monitor circuit for the door switch and serve as components of a bypass circuit for a relay. This arrangement prevents a large current from flowing when monitoring faults with the door switch and also prevents a rush current from flowing during normal operation.

3 Claims, 5 Drawing Figures

HIGH FREQUENCY HEATING APPLIANCE HAVING PROTECTION AGAINST RUSH CURRENTS

This application is a continuation of now abandoned application Ser. No. 444,394, filed Nov. 18, 1982.

FIELD OF THE INVENTION

This invention relates to a monitor circuit for a door safety switch used in high frequency heating appliances such as microwave ovens having an electric wave emission start circuit.

High frequency heating appliances such as microwave ovens generally use a magnetron as a means for generating microwaves and a magnetic leakage type transformer as a means for supplying a high voltage to operate the magnetron. Because of the nature of heating appliances, this transformer must be a high-input power type ranging from 1 KW to 5 KW. When such a large transformer of the magnetic leakage type is used, a very large excitation rush current will flow depending upon the turn-on phase of the power. If $\phi_A$ is the magnetic flux in the core during rated operation, and $\phi_{MAX}$ is the saturated magnetic flux, and $\phi_B$ is the residual magnetic flux, then a magnetic flux of up to $(2\ \phi_A+\phi_B-\phi_{MAX})$ will be generated through the air-core effective cross-sectional area of the coil. The amount of rush current corresponding to this magnetic flux will act as a rush current, whose value is very large, culculated from $$\frac{1}{\mu_0 \cdot n \cdot A} \cdot (2\ \phi_A + \phi_B - \phi_{MAX}),$$

where $\mu_0$ is the permeability of air; n is the number of turns of the primary winding; A is the air-core effective cross-sectional area. As an actually measured value, there is a current value of about 150 A recorded during a period ranging from a half-cycle to 2 cycles.

This rush current has various adverse effects on the appliance itself and on the power source connected thereto. For example, it imposes an excessive load on the switch or relay contacts, sometimes actuating the breaker associated with the power source. Therefore, it is necessary to take measures to avoid rush current.

FIG. 1 shows a circuit conventionally used as such a measure. In the figure, power is supplied through a fuse 1, a timer switch 2 is closed, a door is closed, a door switch 3 is opened, a door switch 4 and a door switch 5 are closed, and a start button is pressed to close a start switch 6, whereupon a current flows through the primary coil of a transformer 8 via a resistor 7 for rush current prevention purposes and a voltage is induced between the 8-*a* terminal and 8-*b* terminals of the primary coil to produce a current flowing through the coil 9-*a* of a relay, closing the contact 9-*b* of the relay to complete the main circuit, with the relay 9 self-holding to supply power to a magnetron 10, thereby generating microwaves.

In this arrangement, since the transformer 8 is excited by a voltage which is lower than the value for normal operation applied thereto, said voltage being supplied for about 20 msec from the time the start switch 6 is closed until the time the relay contact 9-*b* is closed, the rush current at the time when the relay contact 9-*b* is closed so as to complete the main circuit is reduced to a low value. Furthermore, an arrangement for ensuring that upon the opening of the door, the electric waves do not leak, i.e., an arrangement for preventing generation of microwaves upon opening of the door is essential, and its reliability must be very high.

Thus, generally, as shown in FIG. 1, the door switch 4 and door switch 5, adapted to be opened and closed when the door is opened and closed, are provided at different positions on the door to monitor the opening and closing of the door. When the door is opened during operation, however, it cannot absolutely be denied that the load which results from cutting off the circuit and which acts on the door switch 4 or door switch 5 upon opening of the door will never cause troubles such as a fusion of the contact. Thus, in order to further increase reliability so as to ensure that the high frequency heaing appliance will operate satisfactorily throughout its life, an arrangement is made for detecting troubles with the switch 4 so as to cut off the power circuit to thereby stop high frequency oscillation. That is, in this arrangement, if the door switch 4 is damaged and shorted, opening the door closes the door switch 3 to form a short-circuit, thereby allowing a large current to flow which consequently blows the fuse 1, thus securing a safety feature that microwaves will not be generated unless the blown fuse is replaced.

FIG. 2 shows how the switches are attached. Microwaves from the magnetron pass through a waveguide 16 and are suppled to an oven 17. A door 18 is installed on the front side of the oven 17, and a part of a handle 19 forms a movable element 20. Outwardly pulling the handle 19 moves the movable element 20, causing a latch key 21 to rise off a latch hook 22 to thereby make the door 18 ready for opening. In operative connection with the latch key 21, the door switch 4 opens its contact. As the door 18 is opened, a door arm 23 is moved to cause the level of the door switch 3 to return to its original position to close the contact of the door switch 3. An operating panel is installed on the front side of the oven 17, said panel including a button 24 for the start switch 6.

With this conventional arrangement, however, if the power source is 220 V and its impedance is 0.5 Ω, then a large current of 440 A will flow from the time the door switch 3 is closed until the time the fuse 1 is blown, thus producing adverse effects on the power source, such as the cutting-off of the power breaker and an instantaneous drop of source voltage, and presenting problems, such as a fusion of the door switch 3 of the high frequency heating appliance.

Besides these, there has been a circuit shown in FIG. 3. This circuit has a fuse 1 placed in a line which supplies voltage to the coil 9-*a* of a relay 9, so that when the monitor circuit operates, i.e, when the door 18 is opened with the door switch 4 at fault, the fuse 1 will blow, so that the relay 9 will not operate unless the blown fuse 1 is replaced, thus having a safety feature that microwaves will not be generated in such an event. This arrangement, however, also has drawbacks which remain to be eliminated, including cutting-off of the power breaker, since a large current will flow during monitoring.

SUMMARY OF THE INVENTION

Accordingly, an object of the invention is to attain an improvement in safety and reliability by providing protection against rush currents at the start-up time and forestalling ill-effects on a power supply having a breaker etc., which are provided for household circuits, while ensuring monitoring for a shorting failure of the door switch 4.

To serve this end, the present invention provides an appliance for a construction having a transformer 8 for supplying power to the high frequency emission source, a relay contact 9*b* for opening and closing the main circuit for supplying power to this transformer 8, a door switch 4 which, interlocked to the opening and closing of the door, effects opening and closing of the aforementioned main circuit, a door switch 3 which closes with some delay from the opening of the door switch 4, as the door is opened, a bypass circuit connected in parallel with the relay contact 9*b* and monitor circuit which is opened and closed by means of the door switch 3 and which is connected to a different polarity power source on the power supply side, as seen from the relay contact 9*b*, but on the load side, as seen from the door switch 4.

A series connected circuit consisting of a circuit breaker (fuse) 12 and limiting device (resistor) 11 is inserted in a common circuit forming part of the monitor circuit and part of the bypass circuit, and the relay contact is driven by the current supplied at least through the circuit breaker (fuse).

The appliance, therefore, has the effect of enabling the monitoring to be made at a relatively small current value, because in the event of a shorting failure of the aformentioned door switch 4, the shorting current is passed through the limiting device (resistor) 11, causing the circuit breaker (fuse) 12 to open, and moreover, provides protection against rush currents at normal operation time without causing any ill effects on the power supply such as opening of the breaker provided for common household circuits or an instantaneous fall of supply voltage, nor causing a fusion of the door switch 3.

DESCRIPTION OF THE PREFERRED EMBODIMENT

Figure 4:
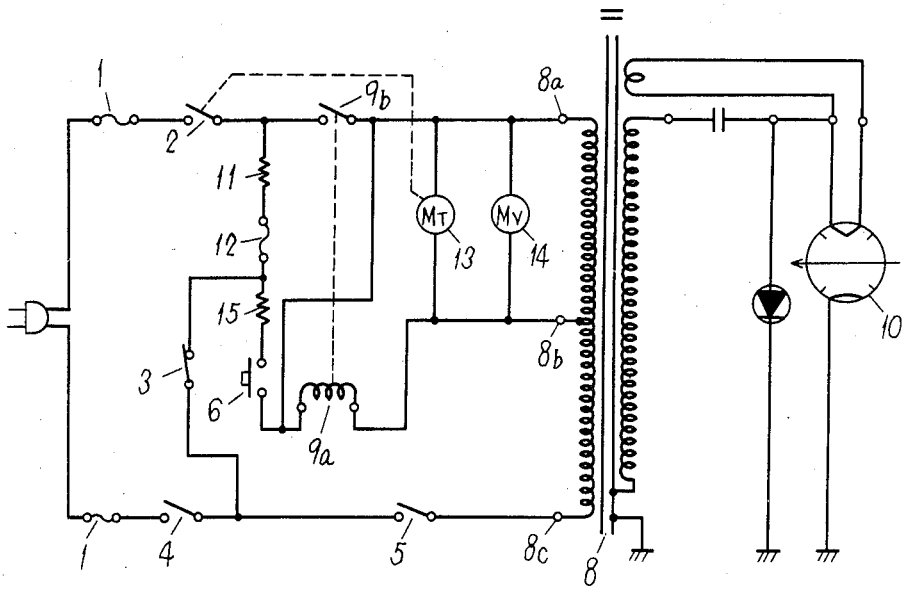
FIG. 4 is a circuit diagram of a high frequency heating appliance showing an embodiment of the present invention.

FIG. 4 shows an electric circuit diagram of a high frequency heating appliance according to an embodiment of this invention. Placed in a monitor circuit formed by a door switch 3, which is an electric wave emission disabling device, are a resistor 11 and a fuse 12 in series with the door switch 3. The resistor 11 and fuse 12 are also components of a start circuit, i.e., a bypass circuit (composed of the resistor 11, fuse 12, resistor 15 and start switch 6) for a relay contact 9-*b*, completed when the start switch 6 is closed, and are connected in series with the start switch 6. The main circuit is completed by extending through a fuse 1, timer switch 2, relay contact 9-*b*, taps 8-*a* and 8-*c* of transformer 8, door switch 5, door switch 4, and back to the fuse 1. The relay coil 9-*a*, timer motor 13 and cooling fan motor 14 are supplied with a voltage produced between taps 8-*a* and 8-*b* of the transformer 8. However, at start-up, the voltage is supplied to said relay coil 9-*a* through resistor 11, fuse 12, resistor 15, and start switch 6. In addition, in this embodiment, it is assumed that the power source is 220 V, 50 Hz and that the rating of the parts is 8 A for the fuse 1, 3 A for the fuse 12 and 10 Ω, 20 W for the resistor 11.

The operation of the above arrangement will now be described with reference to FIG. 5.

Figure 1:
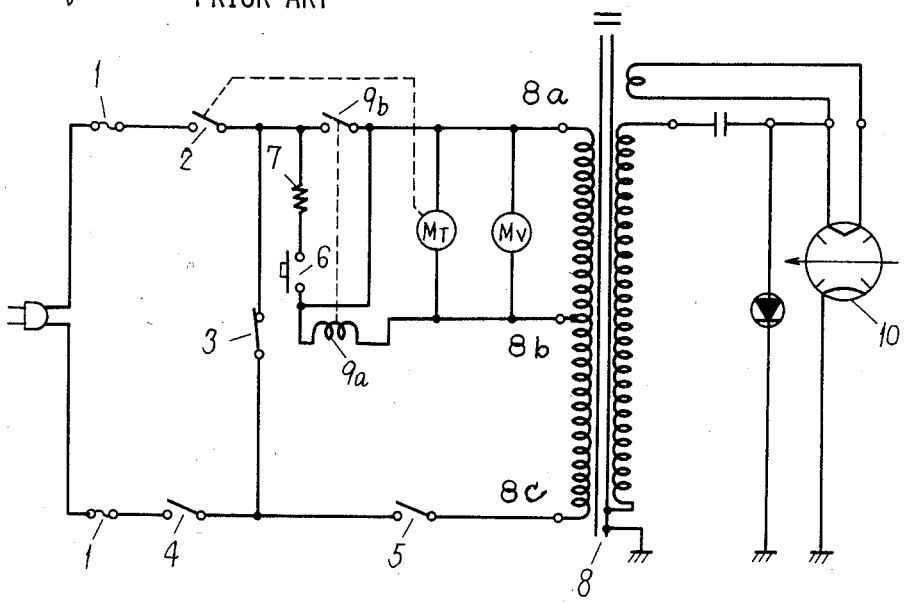
Fig. 1 PRIOR ART
FIG. 1 is an electric circuit diagram of a conventional high frequency heating appliance.
Figure 2:
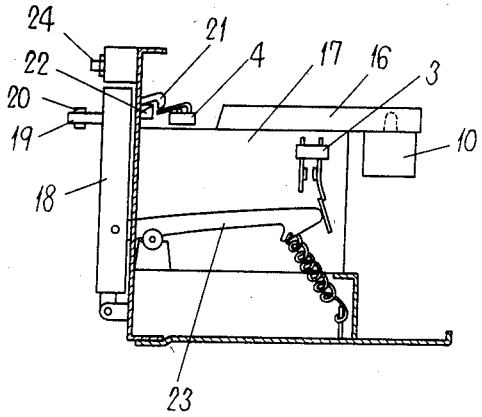
Fig. 2 PRIOR ART
FIG. 2 is a side view of the principal portion of said device, showing how switches are attached.
Figure 3:
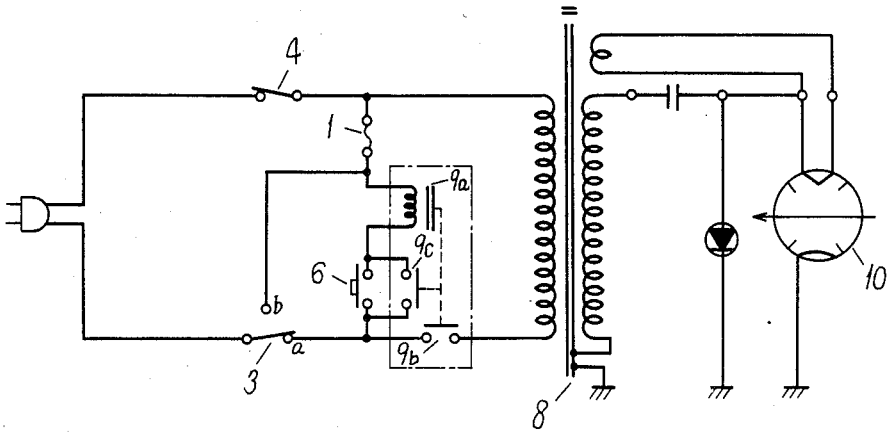
Fig. 3 PRIOR ART
FIG. 3 is an electric circuit diagram of another conventional high frequency heating appliance.
Figure 5:
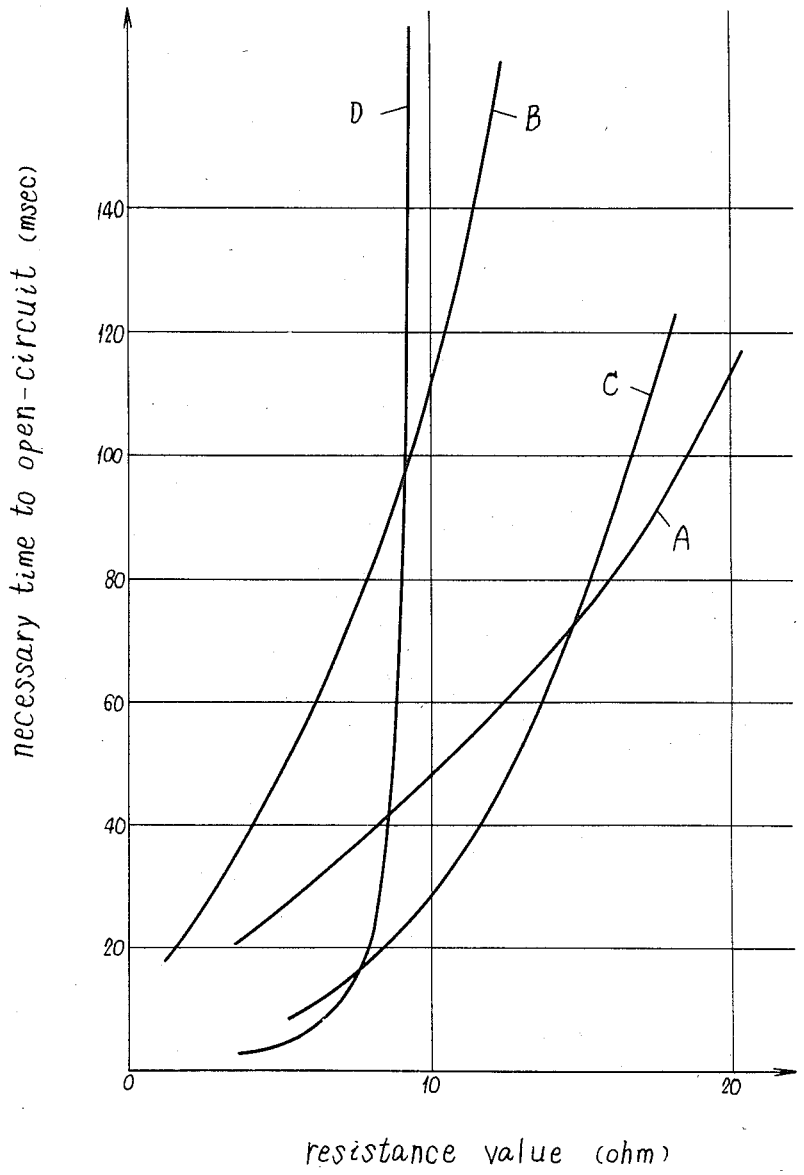
FIG. 5 is a characteristic graph illustrating the operation of the circuit shown in FIG. 4.

FIG. 5 shows the relationships which occur when a 220 V source voltage is supplied across a circuit consisting of a resistor or a circuit having a fuse or a household circuit breaker connected in series with a large capacity resistance. The relationship between the resistance value and the time it takes for the resistor to open, after the voltage has been applied, due to its internal disconnection or the relationship between the resistance value and the time it takes for the fuse to blow, after the voltage has been applied, or the relationship between the resistance value of the resistor and the time it takes for the household circuit breaker to operate after the voltage has been applied, are shown. In this graph, the abscissa represents the resistance value of the resistor, while the ordinate gives the time it takes for the circuit to open under the conditions mentioned above. In particular, the curve A indicates the time it takes for a wire-wound resistor rated at 10 W to open due to its internal wire-disconnection, when the source voltage is supplied thereto. The curve B indicates the time it takes for a wire-wound resistor rated at 20 W to open due to its internal wire-disconnection, when the source voltage is supplied thereto. The curve C indicates the time it takes for a fuse rated at 3 A to blow, when the source voltage is supplied to a circuit having a resistor of a large capacity (i.e.—a resistor which will not sustain such a failure as wire-disconnection or short circuiting, etc.,) connected in series with this fuse. The curve D indicates the time it takes for a household circuit breaker of 10 AH type to open, when the source voltage is supplied to a circuit having a large capacity resistor connected in series with this household circuit breaker. Referring to FIG. 4, if the door switch 4 is at fault and shorted, when the door 18 (shown in FIG. 2) is opened and the timer switch is thereby closed, a closed circuit loop is formed of a series-connected circuit of a first fuse 1 shown in the upper portion of FIG. 4, time switch 2, resistor 11, fuse 12, door switch 3, door switch 4, and a second fuse 1 shown in the lower portion of FIG. 4, and a source voltage of 220 V is supplied thereto, causing the current to flow through the monitor circuit. Now assume that for the aforementioned resistor 11, a 10 Ω wire-wound resistor rated at 3 A is utilized; in addition, a household circuit breaker of 10 A type is connected to the household wiring from which the power is supplied to the appliance. FIG. 5 shows that the time it takes for the circuit to open, when the resistance value is 10 Ω, is shortest with the fuse rated at 3 A, as represented by the curve C. This means that when the aforementioned monitor circuit has operated, the fuse 12 will blow, while the resistor 11 will be unaffected and the household circuit breaker will remain closed (i.e.—not blown). Since the fuse 12 has blown, the start circuit composed of a series-connected circuit of a first fuse 1, timer switch 2, resistance 11, fuse 12, resistor 15, start switch 6, transformer 8, door switch 5, door switch 4, and a second fuse 1 will become inoperative, causing emission of microwaves to cease. The current which flows when the monitor circuit operates is held as low as 22 A due to the 10 Ω of the resistor 11. As hereabove described, according to this embodiment, any short-circuiting failure of the door switch 4 can be surely monitored without letting large currents flow (without causing the household circuit breaker to operate). Since the appliance also will become inoperative, when the resistor is in its wire-disconnection failure mode for whatever reason, safety is assured. Besides, in the manner as above-described, the appropriate resistance value range for the resistor values which is roughly higher than 6 Ω is practical, depending on the rating of the fuse 12, the rated power of the resistor 11 and the rating (essentially its operation characteristics) of the household circuit breaker. The resistor 15 may be eliminated by choosing appropriate parameters for the resistor 11 and the fuse 12.

On the other hand, at the time of normal start-up, a current smaller than the full load current flows to the transformer 8 through a bypass circuit comprising a resistor 11, fuse 12, resistor 15, and start switch 6, (the specifications for the aforementioned fuse 12 being so determined that the fuse 12 will not be effected by this current), thereby exciting the transformer 8 and simultaneously, supplying a voltage to the relay coil 9*a* through the aforementioned resistor 11 and fuse 12. At this time, with the current to the transformer 8 flowing through the resistor 11, the voltage supplied to the aforementioned relay-coil 9*a* will become lower than in normal operation time due to the voltage drop, resulting in delayed operation of the relay contact 9-*b*. Accordingly, the relay contact 9-*b* will be closed only after a lapse of ample time after the current to the aforementioned transformer 8 has begun to flow, making it possible to suppress any rush current flow.

As has been described so far, according to the present invention, in a high frequency heating appliance such as a microwave oven, the absence of a large current flowing from the power source when monitoring troubles with the door safety switch makes it possible to eliminate adverse effects, such as cutting-off of the power breaker and an instantaneous drop of the source voltage, on the power source, and there will be no danger of the monitor door switch being fused; thus a highly reliable, high frequency heating appliance can be provided. Furthermore, the invention uses a current-limiting resistor as a resistor for the start circuit, making it possible to avoid a rush current, a reduction of the life of the contacts of the switches due to the rush current, a degradation of the fuses, and malfunctions of the power source breakers.

We claim:

1. A high frequency heating appliance having a transformer for supplying power to a high frequency emission source, a relay contact for opening and closing a main circuit for supplying power to said transformer, a first door switch interlocked to the opening and closing of a door, said door switch opening and closing said main circuit, a second door switch which is adapted to be closed after a time delay from said opening of said first door switch when said door is opened, a bypass circuit connected in parallel to said relay contact and a monitor circuit which is opened and closed by means of said second door switch;

wherein a series connected circuit consisting of a circuit breaker and a current limiting device is inserted in a common circuit forming part of said monitor circuit and part of said bypass circuit and wherein said relay contact is driven by a current supplied at least through said circuit breaker.

2. A high frequency heating appliance according to claim 1, wherein start-up means are provided in said bypass circuit.

3. A high frequency heating appliance according to claim 1, wherein start-up means are provided in said main circuit.

* * * * *